US007685781B1

(12) United States Patent
Hatch

(10) Patent No.: US 7,685,781 B1
(45) Date of Patent: Mar. 30, 2010

(54) MOBILE HOME SKIRT GUARD

(76) Inventor: Anthony Hatch, 72 Highpoint Pl., Bradley, ME (US) 04411

( * ) Notice: Subject to any disclaimer, the term of this patent is extended or adjusted under 35 U.S.C. 154(b) by 0 days.

(21) Appl. No.: 12/012,436

(22) Filed: Feb. 4, 2008

(51) Int. Cl.
*E04B 1/343* (2006.01)
*E04C 2/38* (2006.01)

(52) U.S. Cl. ..... 52/169.12; 52/DIG. 3; 52/716.8; 52/800.12

(58) Field of Classification Search ..... 52/717.05, 52/716.8, 716.4, 717.01, 718.01, 717.03, 52/169.12, 288.1, 287.1, 506.01, 506.05, 52/DIG. 3, DIG. 11, 800.12
See application file for complete search history.

(56) References Cited

U.S. PATENT DOCUMENTS 1,803,589 A * 5/1931 Bohnsack ..... 52/241
3,435,574 A * 4/1969 Hallock ..... 52/278
3,694,979 A * 10/1972 Vadnie ..... 52/169.12
3,753,323 A * 8/1973 Nesbitt ..... 52/169.12
3,827,201 A * 8/1974 Struben ..... 52/169.12
3,832,813 A * 9/1974 Hindman ..... 52/169.12
3,834,109 A * 9/1974 Iacona ..... 52/741.11
4,043,088 A * 8/1977 Payton ..... 52/169.12
4,214,412 A * 7/1980 Barylski ..... 52/169.12
4,352,261 A * 10/1982 Wargo ..... 52/169.12
4,400,919 A * 8/1983 Szabo et al. ..... 52/169.12
4,549,378 A * 10/1985 Ayers et al. ..... 52/169.12
4,843,793 A * 7/1989 Ayers ..... 52/169.12
4,996,807 A * 3/1991 Walgamuth ..... 52/169.12
5,537,791 A * 7/1996 Champagne ..... 52/520
5,829,206 A * 11/1998 Bachman ..... 52/94
5,907,933 A * 6/1999 Stanfill ..... 52/169.12
6,076,327 A * 6/2000 Hendrickson ..... 52/717.05

* cited by examiner

*Primary Examiner*—Robert J Canfield
*Assistant Examiner*—Babajide Demuren
(74) *Attorney, Agent, or Firm*—Joseph E. Funk

(57) ABSTRACT

A skirt guard for a mobile home skirt having a skirt base on the ground and in a channel of which the bottom of the skirt sits. The skirt guard is formed of a flat elongate panel with a top and bottom edge and having a groove near and parallel to its bottom edge. In use the bottom edge of the skirt guard is bent upward along the groove to form a hook. To install the skirt guard the hook is inserted into the skirt base channel alongside the bottom of the skirt and the hook fastens the skirt guard in the channel.

12 Claims, 3 Drawing Sheets

MOBILE HOME SKIRT GUARD

FIELD OF THE INVENTION

The present invention relates to mobile home skirting and more particularly to a guard for protecting the skirting.

BACKGROUND OF THE INVENTION

Manufactured homes, also known as mobile homes, modular homes or pre-manufactured homes have been known for many years and are commonly installed by being placed on concrete slabs or concrete footings or even on cinder blocks. Typically, the peripheral lower edges of the manufactured home are not continuously supported and stretches of same are unsupported. This leaves a gap between the unsupported lower edges and the ground. In the past this gap has been covered by a non-load bearing "skirt" fabricated from a synthetic materials to provide a more pleasing appearance for the manufactured home. The bottom edge of the skirt typically sits in a "base" that is fastened to the ground or other footing to prevent the bottom edge of the skirt from moving around and breaking. However, over extended periods of time, the lower edges of the skirts are typically damaged by many things including weed whacker lines, lawn mowers, other gardening tools and children's toys because the skirts are not structurally strong enough to prevent such damage.

Therefore, there is a need in the art for a "skirt guard" that is attached to the lower edge of a mobile home skirt and provides protection for the standard skirt against weed whacker lines, lawn mowers, toys, gardening tools, etc. In addition, there is a need for a skirt guard that is cost effective, provides a pleasing appearance to the existing skirting, and is dependable for many years. In addition, there is a need for a skirt guard that may be used to cover existing damage to the bottom edge of skirts and thus improve their aesthetic appearance.

SUMMARY OF THE INVENTION

The foregoing need in the prior art for a "skirt guard" that is attached to the lower edge of a mobile home skirt is satisfied by the present invention. The novel skirt guard disclosed and claimed herein is preferably made of a tough thermoplastic, provides protection for standard mobile home skirts against weed whacker lines, lawn mowers, toys, gardening tools, etc., provides a pleasing appearance to existing skirts, and covers existing damage to the bottom edge of skirts and thereby improves their aesthetic appearance. In addition the skirt guard is easily installed.

The "skirt guard" is made of a tough thermoplastic that is preferably extruded in long strips for cost savings. The skirt is shipped in a standard length of eight feet, but other lengths may be provided.

A conventional manufactured home skirt is attached to the peripheral lower edge of a mobile home structure. To support the bottom edge of the skirt a "skirt base" is fastened to the ground or to a concrete slab on which the mobile home sits. The bottom edge of the skirt sits within a channel in the skirt base and this prevents the bottom edge of the skirt from moving around and breaking. The bottom edge of the skirt guard is inserted into the skirt base alongside the skirt, and the top edge of the skirt guard is typically fastened to the skirt using fasteners.

DESCRIPTION OF THE DRAWINGS

The invention will be better understood upon reading the following Detailed Description in conjunction with the drawing in which.

DETAILED DESCRIPTION

Figure 6:
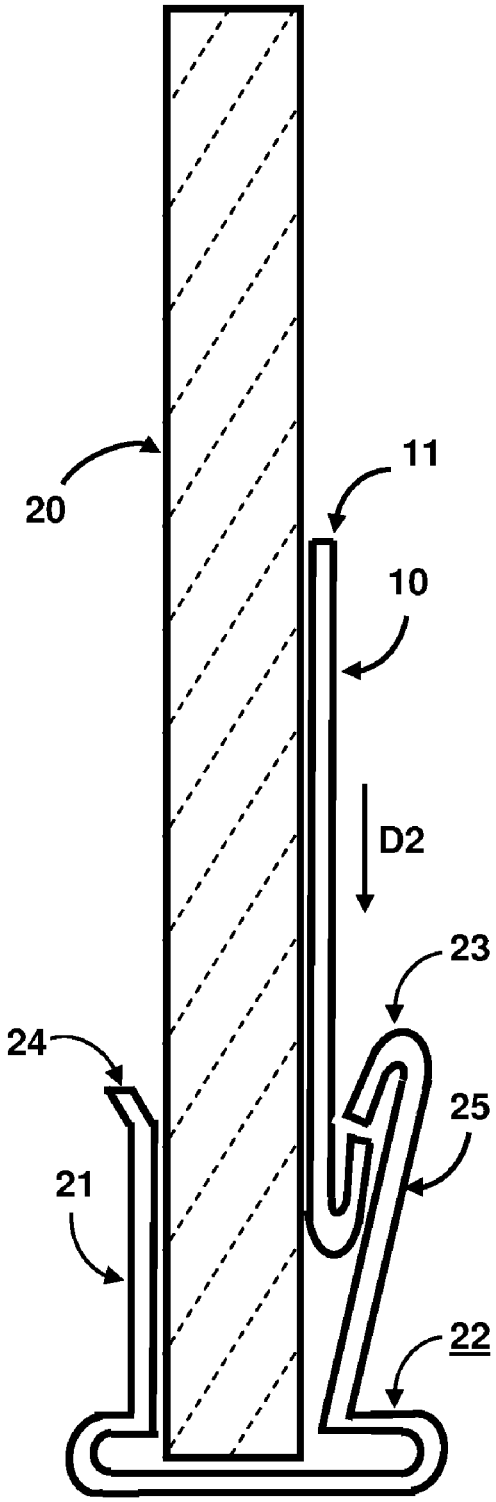
FIG. 6 is an end view of a prior art skirt mounted in a skirt base with a skirt guard also mounted in the skirt base against the skirt.
Figure 7:
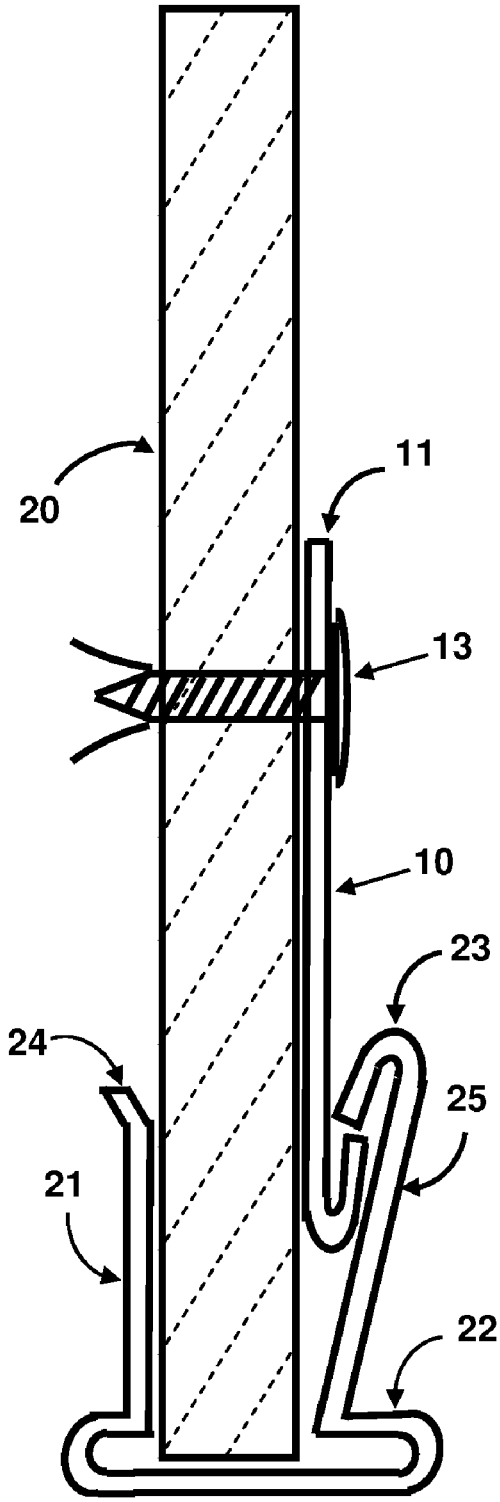
FIG. 7 is an end view of a prior art skirt mounted in a skirt base with a skirt guard also mounted in the same skirt base against the skirt with a fastener used to fasten the top edge of the skirt guard against the skirt.

In the following description the term mobile home is used but the invention can also be used with other manufactured housing. In the drawings the scaling of the skirt, skirt guard and skirt base with respect to each other are deliberately out of scale to better show details of the elements. For example, in FIGS. 6 and 7 skirt guard 10 appears to be over half the height of skirt 20 which is incorrect. Skirt 20 is well over a foot high while skirt guard 10 is only six inches high. For another example, in FIG. 1 skirt base 22 is shown out of scale (larger) with respect to skirt 20 to better see the details of skirt base 22. The bottom edge 26 of skirt 20 normally sits in the generally "U" shaped area of skirt base 22 as shown in FIGS. 6 and 7.

Figure 1:
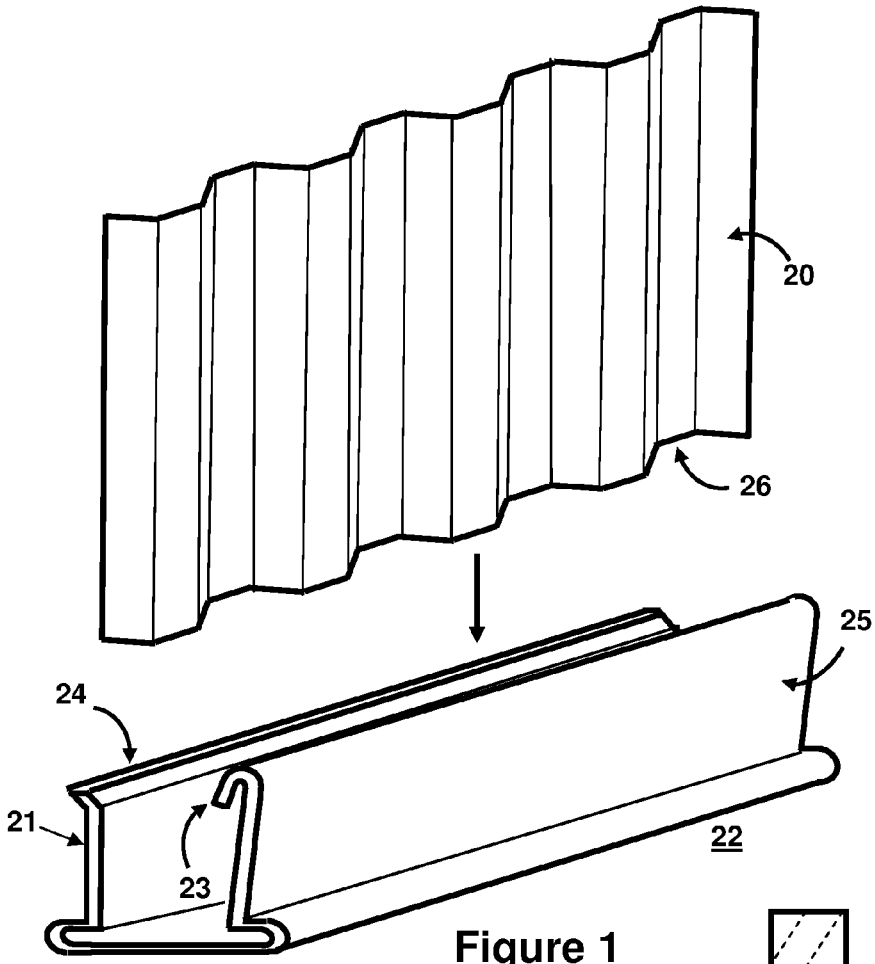
Figure 1 (prior art)
FIG. 1 shows a prior art "skirt" and "skirt base"

Referring to FIG. 1, therein is shown a prior art "skirt" 20 and "skirt base" 22. As shown, skirt 20 is not perfectly flat but has a corrugated surface that aids in its rigidity. Skirt 20 is shown positioned above skirt base 22 in preparation for inserting the bottom peripheral edge 26 of skirt 20 into skirt base 22. Skirt base 22 has two generally perpendicular walls or legs 21 and 25 that form a "U" channel therein. The top edge 23 of the skirt base front wall 25 that is seen from outside a mobile home is formed over and downward in an inverted "J" shape. The inverted "J" shape facilitates mounting skirt 20 in the "U" channel of skirt base 22. The top 24 of the skirt base rear wall 21 not seen from outside a mobile home is angled outward to facilitate the insertion of the bottom peripheral edge 26 of skirt 20 into skirt base 22.

Figure 2:
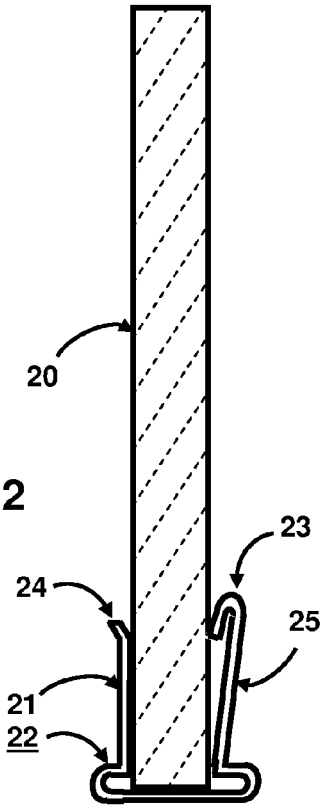
Figure 2 (prior art)
FIG. 2 shows an end view of a prior art skirt mounted in a skirt base.

FIG. 2 shows an end view of prior art skirt 20 mounted in a prior art skirt base 22. In this position skirt 20 pushes outward on the top 23 of the skirt base front wall 25 which deflects it slightly and thereby facilitates firmly holding the bottom peripheral edge 26 of skirt 20.

Figure 3:
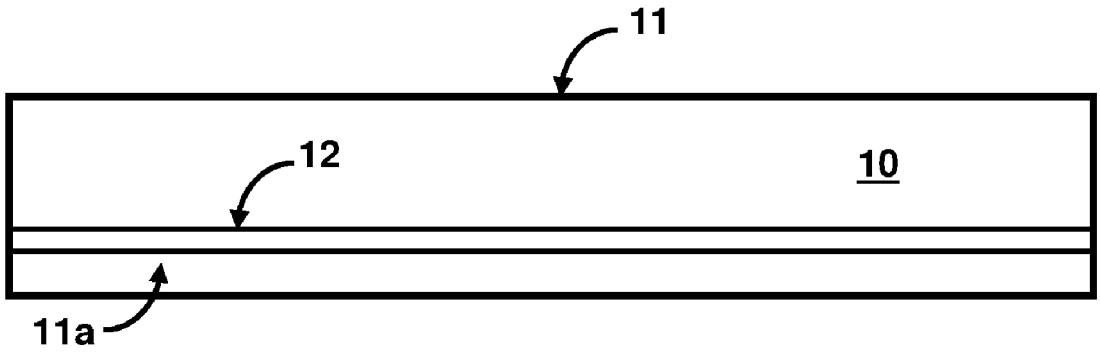
FIG. 3 is a front view of a "skirt guard" as it is obtained for use.

FIG. 3 shows a front view of my new "skirt guard" 10 as it is obtained from a supply house for use. Skirt guard 10 is typically extruded flat, as shown, from a high-density thermoplastic and is tough to withstand normal abuse without being damaged. Skirt guard 10 is preferably 7 inches high by 8 feet long and between 0.060 and 0.80 inches thick. A groove 12 in the surface and along the length of skirt guard 10 defines an upper portion 11 of the skirt guard that is six inches in height, and defines a lower portion 11*a* of the skirt guard that is one inch in height. However, other materials and dimensions may be preferable for specific applications. Skirt guard 10 is made in different colors and decorative patterns may be printed thereon for aesthetic purposes.

Figure 4:
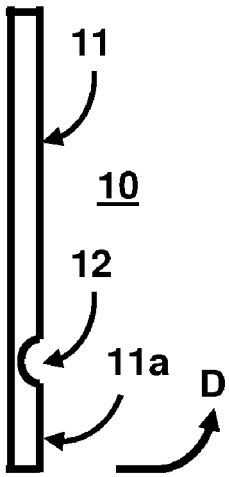
FIG. 4 is an end view of a skirt guard as it is obtained for use.

Groove 12 is better shown in FIG. 4 and is used to prepare skirt guard 11 for use as will be better understood upon reading further in this detailed description. The dimension from the middle of groove 12 to the top peripheral edge of skirt guard 10 is six inches and defines the upper, visible portion 11 of the skirt guard. The dimension from the middle of groove 12 to the bottom peripheral edge of skirt guard 10 is one inch and defines the lower portion 11*a* of the skirt guard.

FIG. 4 shows an end view of a skirt guard 10 as it is obtained for use. Groove 12 is best shown in this figure. Groove 12 is shown as being semicircular but it may be part of an oval shape. The purpose for groove 12 is to provide a strain relief point that permits the lower portion 11*a* of the skirt guard 10 to be folded in the direction of arrow D to the "J" shape shown in FIG. 5.

Figure 5:
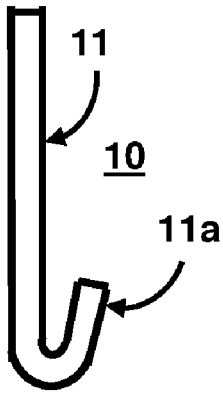
FIG. 5 is an end view of a skirt guard after it has been configured for use.

FIG. 5 shows an end view of a skirt guard 10 after its one inch wide lower edge 11*a* is folded to form a cross-sectional "J" shape. This "J" shaped bottom edge of skirt guard 10 is used to fasten the bottom edge of skirt guard 10 to skirt base 21 as is better seen in and described with reference to FIG. 6.

FIG. 6 shows an end view of a skirt guard 10 after it is inserted into a skirt base 22 alongside a skirt 20. Initially, skirt guard 10 is placed flat against the side of a skirt 20 and then is pushed downward in the direction of arrow D2. The "J" shaped bottom edge of skirt guard 10 first contacts the inverted "J" shaped edge 23 at the top of the front wall 25 of the skirt base 22 and as skirt guard 10 is pushed further downward the top edge 23 is deformed away from skirt 20 permitting the "J" shaped bottom edge of skirt guard 10 to pass inside skirt base 22. At this point top edge 23 partially returns toward skirt 20 and thereby locks the "J" shaped edge of skirt guard 10 inside skirt base 22 as shown in FIG. 6.

FIG. 7 is the same as FIG. 6 except the upper portion of skirt guard 10 is securely fastened to skirt 20. Along the length of skirt guard 10 a plurality of spaced holes are drilled through skirt guard 10 and skirt 20. Through each of these holes (not shown) a push through anchor 13 is inserted to thereby lock skirt guard 10 to skirt 20. In FIG. 7 only one of these anchors 13 is shown due to the figure being an end view.

Figure 8:
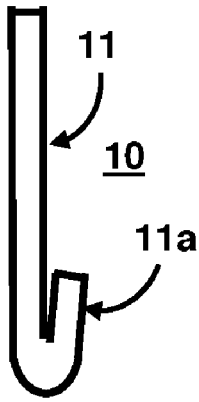
FIG. 8 is an end view of an alternative embodiment of the skirt guard that is manufactured for end use.

In an alternative embodiment of the invention shown in FIG. 8 skirt guard 10 is not manufactured flat (FIG. 3) with a groove 12, but rather is manufactured already having the shape shown in FIG. 8, or having a shape very similar.

While what has been described herein is the preferred embodiment of the invention those skilled the art will recognize that numerous changes may be made without departing from the spirit and scope of the invention.

The invention claimed is:

1. A skirt guard for a mobile home skirt having a skirt base on the ground, the skirt guard comprising:

a vertically oriented elongated panel having a length and width, having a front surface, a rear surface, a top edge, a bottom edge, and a groove parallel to and along the length of the panel near the bottom edge of the elongated panel;

wherein the groove defines a lower panel area below the groove;

wherein the lower panel area is bent upward along the groove close to one-hundred eighty degrees to form a first hook along the bottom edge of the skirt guard panel;

wherein the skirt base has a channel in which the bottom edge of the skirt sits; and wherein the first hook along the bottom edge of the skirt guard panel is inserted into the channel in the skirt base alongside the bottom edge of the skirt and the first hook fastens the skirt guard panel in the skirt base channel.

2. The skirt guard for a mobile home skirt in accordance with claim 1 further comprising means for attaching the top edge of the skirt guard elongated panel to the mobile home skirt.

3. The skirt guard for a mobile home skirt in accordance with claim 2 wherein the skirt comprises a corrugated vertical panel.

4. The skirt guard for a mobile home skirt in accordance with claim 1 wherein the skirt base has a floor, an upstanding rear leg attached to said floor, and an upstanding forward leg attached to said floor and spaced apart from said upstanding rear leg, thereby defining the channel disposed to receive the bottom edge of the skirt.

5. The skirt guard for a mobile home skirt in accordance with claim 4 wherein the top of the upstanding forward leg of the skirt base is bent inward forming a second hook, and wherein when the first hook along the bottom edge of the skirt guard panel is inserted into the channel in the skirt base alongside the bottom edge of the skirt the first hook fastens the skirt guard panel to the second hook.

6. The skirt guard for a mobile home skirt in accordance with claim 1 wherein the skirt base channel has a top edge bent inward forming a second hook, and wherein when the first hook along the bottom edge of the skirt guard panel is inserted into the skirt base channel alongside the bottom edge of the skirt the first hook fastens the skirt guard panel to the second hook.

7. A skirt guard for a mobile home skirt having a skirt base on the ground, the skirt guard comprising:

a vertically oriented elongated panel having a length and width, having a front surface and a rear surface, and having a bottom edge that is bent upward close to one-hundred eighty degrees to form a hook;

wherein the skirt base has a channel in which the bottom edge of the skirt sits;

wherein the skirt base channel has a top edge bent inward forming a second hook;

wherein the hook along the bottom edge of the skirt guard panel is inserted into the channel in the skirt base alongside the bottom edge of the skirt and the first hook fastens the skirt guard panel to the second hook of the skirt base channel.

8. The skirt guard for a mobile home skirt in accordance with claim 7 further comprising means for attaching the top edge of the skirt guard panel to the mobile home skirt.

9. The skirt guard for a mobile home skirt in accordance with claim 8 wherein the skirt comprises a corrugated vertical panel.

10. The skirt guard for a mobile home skirt in accordance with claim 7 wherein the skirt base has a floor, an upstanding rear leg attached to said floor, and an upstanding forward leg attached to said floor and spaced apart from said upstanding rear leg, thereby defining the channel disposed to receive the bottom edge of the skirt.

11. The skirt guard for a mobile home skirt in accordance with claim 10 wherein the top of the upstanding forward leg is bent inward forming a second hook, and wherein the first hook along the bottom edge of the skirt guard panel is inserted into the channel in the skirt base alongside the bottom edge of the skirt and the first hook fastens the skirt guard panel to the second hook.

12. The skirt guard for a mobile home skirt in accordance with claim 7 wherein the skirt base channel has a top edge bent inward forming a second hook, and wherein the first hook along the bottom edge of the skirt guard panel is inserted into the skirt base channel alongside the bottom edge of the skirt the first hook fastens the skirt guard panel to the second hook.

* * * * *